United States Patent [19]

Laitinen et al.

[11] Patent Number: 4,961,824

[45] Date of Patent: Oct. 9, 1990

[54] METHOD FOR MANUFACTURING MULTILAYER BOARD

[76] Inventors: Leo S. Laitinen, Näädänkuja 5, Huutjärvi, Finland, SF-49210; Veikko K. T. Waris, Rimmonkatu 17, Kyminlinna, Finland, SF-48700

[21] Appl. No.: 298,237

[22] Filed: Jan. 13, 1989

Related U.S. Application Data

[63] Continuation of Ser. No. 822,433, Dec. 17, 1985, abandoned.

[30] Foreign Application Priority Data

May 11, 1984 [FI] Finland ..... 841895

[51] Int. Cl.[5] ..... D21F 11/04

[52] U.S. Cl. ..... 162/123; 162/132; 162/133

[58] Field of Search ..... 162/123, 125, 129, 130, 162/132, 133, 299, 300, 303

[56] References Cited

U.S. PATENT DOCUMENTS 2,881,672 4/1959 Thomas ..... 162/123
3,839,143 10/1974 Suckow ..... 162/123
3,985,612 10/1976 Watanabe ..... 162/133
4,376,012 3/1983 Bergstrom ..... 162/123
4,425,187 1/1984 Armstrong et al. ..... 162/299

FOREIGN PATENT DOCUMENTS 1428401 3/1976 United Kingdom ..... 162/132

*Primary Examiner*—Peter Chin
*Attorney, Agent, or Firm*—Nixon & Vanderhye

[57] ABSTRACT

A method for manufacturing multilayer board in which the pulp suspension forming a surface layer (12) is fed onto the horizontal section of a first, inner wire (1). The pulp suspension forming an intermediate layer (11) is supplied onto said web layer, which is already formed, in or in front of a tapering gap (6) constituted by the first wire and a second, outer wire (4). Both of the wires and the web layers (11, 12) between them are guided over a curved surface (3). After this the first wire and both of the web layers are guided against a third wire (8) onto the horizontal section of which the pulp suspension forming the other surface layer (13) is supplied. The consistency of the pulp suspension forming the intermediate layer (11) is remarkably higher than that of the pulp suspensions forming the surface layers (12, 13).

3 Claims, 1 Drawing Sheet

METHOD FOR MANUFACTURING MULTILAYER BOARD

This is a continuation of application Ser. No. 06,822,403, filed Dec. 17, 1985, now abandoned.

Technical Field

The present invention relates to a method for manufacturing multilayer board in which the pulp suspension forming a surface layer is fed onto a first, inner wire; the pulp suspension forming an intermediate layer is supplied onto the first web, which is already formed, in a tapering gap consisting of the first wire and a second, outer wire; and the wires and the web layers between them are guided over a curved surface after which the first wire and both of the web layers are guided against a third wire onto which the pulp suspension forming the other surface layer is supplied.

Background Art

A method for manufacturing multilayer board is disclosed by Finnish patent application No. 82 1194. According to this patent application, pulp suspensions containing large quantities of water cannot, however, be supplied into the gap between the first and the second wire without disturbing the web formation which limits the grammage of the intermediate layer.

Disclosure of the Invention:

It is an object of the present invention to provide a method for manufacturing multilayer board in which the grammage of the intermediate layer supplied by one headbox is high.

The present invention is substantially characterized by the feature that the pulp suspension forming the intermediate layer is fed onto the wire at a much higher consistency than the suspensions forming the surface layers.

The consistency of the pulp suspension forming the intermediate layer is 2 to 15%, preferably 3 to 6%. As the pulp suspension is fed at a high consistency it has no detrimental effects on the web layer onto which is supplied, and the amount of the water to be removed is small which decreases the space and energy requirements of the machine.

The method of the invention yields good bonding strength between the web layers and high bulk.

Because the pulp suspension forming the intermediate layer is fed at a very high consistency the fibre structure of the formed web differs from that of the surfaces layers. It forms a three-dimentional network structure the z-strength, i.e. strength in vertical direction against the sheet level, is high. Water is easily drained from the pulp layer. Further, flow through the sheet is small and retention of the fines is good compared to conventional sheet formation.

Brief Description of the Drawing

The invention is described in detail below with reference to the accompanying drawing where a device for carrying out the method is illustrated schematically.

Best Mode of Carrying out the Invention:

Figure 1:
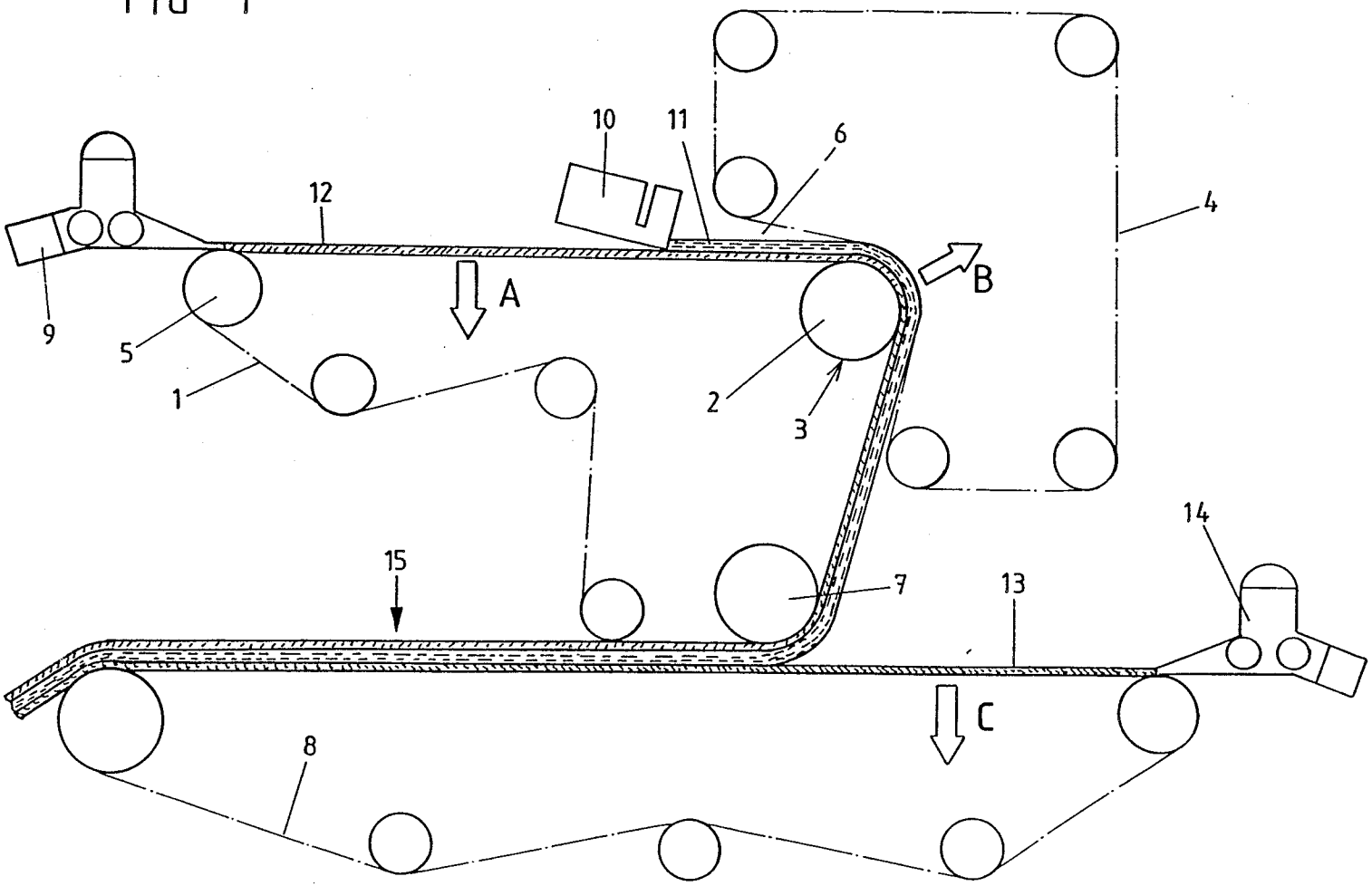

The multilayer board machine illustrated in the drawing comprises an inner wire 1, which is guided to run over the surface 3 of a dewatering roll 2; and another, outer wire 4 which too is guided to run over the dewatering roll 2. The inner wire runs from the breast roll 5 to the dewatering roll substantially in horizontal direction. The outer wire 4 forms with the lower wire 1 a gap 6 which tapers towards the dewatering roll. After the dewatering roll the wires run downwards and the outer wire is detached from the inner wire. The inner wire is turned by a roll 7 against the section of a third, lower wire 8 which travels substantially in horizontal direction.

The pulp suspension forming the first surface layer of the board is fed onto the first wire 1 by a headbox 9 operating at the conventional consistency range of 0.1 to 1.5% and being supplied at the breast roll 5. In the horizontal section of the wire water is drained in the direction of arrow A, i.e. downwards. A high consistency headbox 10 disposed in front of a gap 6 formed by the first and the second wire feeds the pulp suspension forming an intermediate layer 11 onto a web 12 which is already formed. The high consistency headbox operates at a consistency range of 2 to 15%, preferably 3 to 6%.

The high consistency headbox can be e.g. a pulp feeding device as disclosed in US Pat. No. 4,021,296.

By the dewatering roll 2 the web layers 11 and 12 run between the inner and the outer wire and dewatering takes place in the direction of arrow B, i.e. upwards.

The pulp suspension forming the other surface layer 13 is fed by a headbox 14 operating at a conventional consistency range onto a wire 8 where dewatering is realized in the direction of arrow C, i.e. downwards. The web layers are bonded on the horizontal section of the wire 8 and after this a web 15 comprising three layers is guided by known methods to the press and dryer sections of a board machine for further treatment.

The invention is not limited to the described embodiment, which is presented as an example, only, but several modifications and applications may be made of it within the scope of the inventive idea defined by the patent claims. E.g. a curved shoe, which can be smooth or made of ribs, may be installed in front of the dewatering roll. Between the turning roll 7 and the headbox 14 or the headboxes 9 and 10, a fourth headbox may be provided to supply another intermediate layer on the horizontal section of the lower wire 8. The surface of the dewatering roll can be smooth or show recesses.

We Claim:

1. A method for manufacturing three-layer paperboard web comprising the following steps:

providing a high-consistency headbox and two low-consistency headboxes;

feeding a low-consistency pulp suspension from one of the low-consistency headboxes onto a first, inner wire thereby forming a first surface layer on said first wire;

subsequently feeding a high-consistency pulp suspension from the high-consistency headbox onto the top surface of said first surface layer in or in front of a tapering gap formed by the first wire and a second outer wire, the first wire, between the feed form said high-consistency headbox and said gap, being unsupported by underlying structure;

guiding both of said first and second wires with said first surface layer and said intermediate layer between said first and second wires pressing the wires together and over a dewatering roll so as to dewater said intermediate layer in a direction away from said top surface layer;

detaching said second wire from said intermediate layer directly upon said layers leaving said dewatering roll, and subsequently;

feeding a low-consistency pulp suspension from the other low-consistency headbox onto a third wire thereby forming a second surface layer;

guiding the first wire and both said first surface layer and said intermediate layer against said third wire onto which the second surface layer of low-consistency pulp suspension has been supplied;

wherein the pulp suspension forming the intermediate layer and supplied from the high-consistency headbox has a consistency of 1.5% to 10% and the pulp suspensions forming the first and second surface layers and supplied from low-consistency headboxes, respectively, have consistencies of 0.1% to 1.0%; and dewatering both low-consistency pulp suspensions on the respective first and third wires prior to contacting the low-consistency suspensions with the high-consistency suspension of the intermediate layer, the web layers being bonded to one another on a horizontal section of the third wire.

2. A method according to claim 1 wherein the consistency of the pulp suspension forming the intermediate layer is 2% to 5%.

3. A method according to claim 1 wherein said high-consistency pulp suspension is fed from said high-consistency headbox in the form of a paper sheet onto said first surface layer.

* * * * *